US007234527B2

(12) United States Patent
Nivens et al.

(10) Patent No.: US 7,234,527 B2
(45) Date of Patent: Jun. 26, 2007

(54) SYSTEM AND METHOD FOR FAIL-SAFE DISCONNECT FROM A SUBSEA WELL

(75) Inventors: Harold W. Nivens, Runaway Bay, TX (US); Curtis E. Wendler, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 234 days.

(21) Appl. No.: 10/189,889

(22) Filed: Jul. 3, 2002

(65) Prior Publication Data

US 2004/0003926 A1 Jan. 8, 2004

(51) Int. Cl.
*E21B 29/12* (2006.01)

(52) U.S. Cl. ..... 166/340; 166/351; 166/363

(58) Field of Classification Search ..... 166/340, 166/339, 352, 351, 359, 363, 364, 337, 123, 166/133, 194
See application file for complete search history.

(56) References Cited

U.S. PATENT DOCUMENTS

| | | | | | |
|---|---|---|---|---|---|
| 2,274,093 | A | * | 2/1942 | Ragland et al. | 166/114 |
| 3,179,179 | A | * | 4/1965 | Kofahl | 166/352 |
| 3,219,117 | A | * | 11/1965 | Johnstone et al. | 166/352 |
| 3,299,954 | A | * | 1/1967 | Williams et al. | 166/298 |
| 3,321,217 | A | * | 5/1967 | Ahlstone | 285/18 |
| 3,457,991 | A | * | 7/1969 | Sizer et al. | 166/363 |
| RE27,464 | E | * | 8/1972 | Taylor, Jr. | 166/363 |
| 3,797,573 | A | * | 3/1974 | Crowe | 166/321 |
| 3,827,468 | A | * | 8/1974 | Markham | 144/136.1 |
| 3,850,237 | A | * | 11/1974 | Ahlstone et al. | 166/336 |
| 3,870,101 | A | * | 3/1975 | Helmus | 166/363 |
| 3,967,647 | A | * | 7/1976 | Young | 137/614.11 |
| 4,116,272 | A | * | 9/1978 | Barrington | 166/340 |
| 4,216,834 | A | * | 8/1980 | Wardlaw | 175/7 |
| 4,253,525 | A | * | 3/1981 | Young | 166/336 |
| 4,310,048 | A | * | 1/1982 | Mott | 166/212 |
| 4,320,804 | A | * | 3/1982 | Brooks | 166/339 |
| 4,372,392 | A | | 2/1983 | Barrington et al. | |
| 4,448,216 | A | | 5/1984 | Speegle et al. | 137/630 |
| 4,494,609 | A | | 1/1985 | Schwendemann | 166/336 |
| 4,636,934 | A | | 1/1987 | Schwendemann et al. | 364/132 |

(Continued)

FOREIGN PATENT DOCUMENTS

GB 2 369 839 A 6/2002

OTHER PUBLICATIONS

EPO Communication (1 page) and Partial European Search Report (3 pages) regarding EPO Reference No. PAC/21804 EP, Application No. 03254199.7-1266, dated Jan. 28, 2005.

(Continued)

*Primary Examiner*—Thomas A Beach
(74) *Attorney, Agent, or Firm*—Fish & Richardson P.C.

(57) ABSTRACT

A system and method for controllably separating a conduit into an upper portion and a lower portion. The system includes a first valve in the upper portion of the conduit above a point of separation, and a second valve in the lower portion of the conduit below the point of separation. When the conduit is separated, the valves are actuated to cease flow therethrough and prevent loss of fluids into the seawater. A hang-off tool in the lower portion of the conduit engages the well and supports the lower portion of the conduit.

40 Claims, 10 Drawing Sheets

U.S. PATENT DOCUMENTS

| | | | | |
|---|---|---|---|---|
| 4,844,166 | A * | 7/1989 | Going et al. | 166/379 |
| 4,880,060 | A | 11/1989 | Schwendemann et al. | 166/336 |
| 5,086,843 | A | 2/1992 | Mims et al. | |
| 5,172,717 | A | 12/1992 | Boyle et al. | |
| 5,179,973 | A | 1/1993 | Dickson et al. | 137/433 |
| 5,343,963 | A | 9/1994 | Bouldin et al. | |
| 6,055,213 | A | 4/2000 | Rubbo et al. | |
| 6,070,668 | A * | 6/2000 | Parks et al. | 166/345 |
| 6,182,762 | B1 * | 2/2001 | Harris | 166/339 |
| 6,354,379 | B2 | 3/2002 | Miszewski et al. | |
| 6,648,073 | B1 * | 11/2003 | Jernigan et al. | 166/336 |

OTHER PUBLICATIONS

EPO Communication (1 page) and Partial European Search Report (3 pages) regarding EPO Reference No. PAC/21804 EP, Application No. 03254199.7-1266, dated Jan. 28, 2005.

EPO Communication (1 page) and European Search Report (4 pages) regarding EPO Reference No. PAC/21804 EP, Application No. 03254199.7, dated Jul. 19, 2005.

* cited by examiner

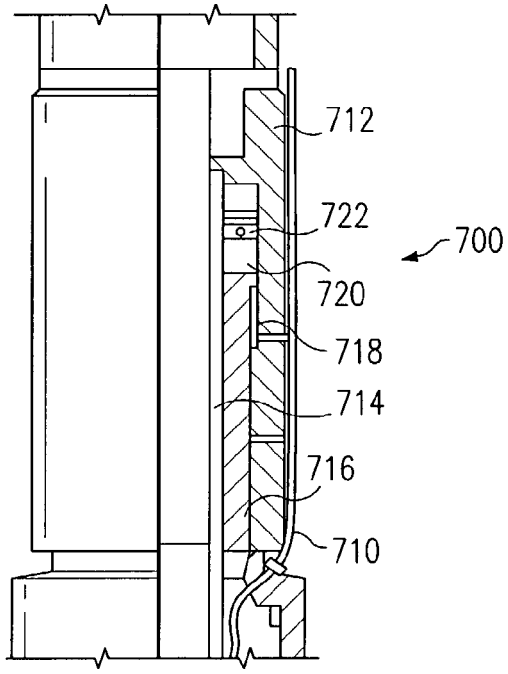
FIG. 7
FIG. 9
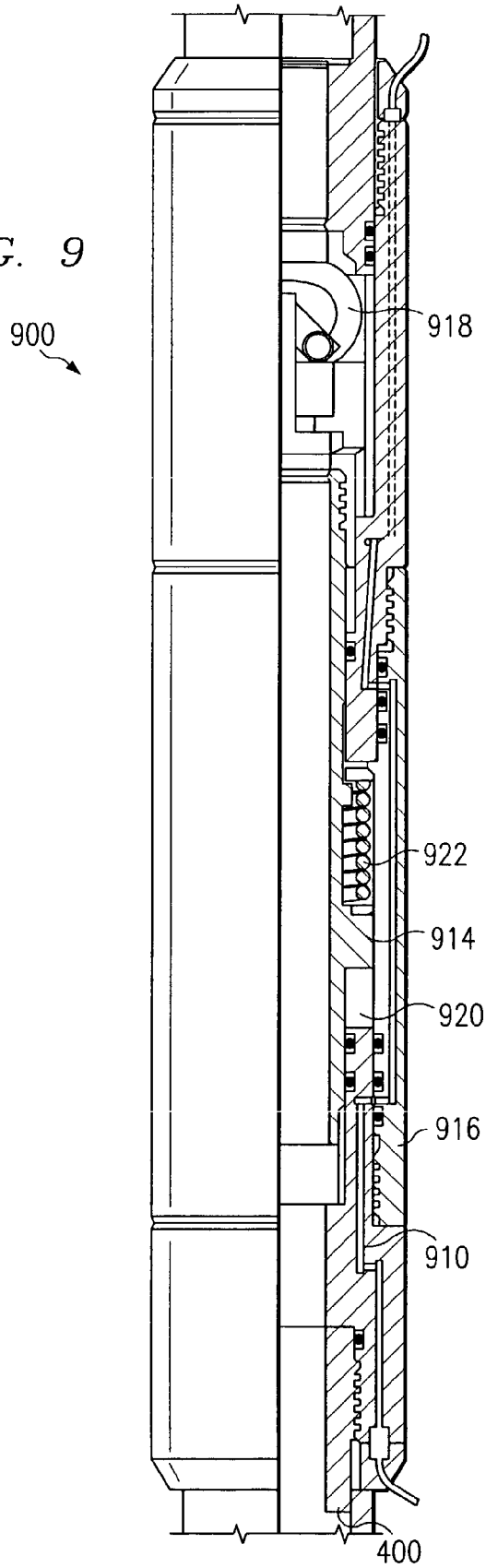

SYSTEM AND METHOD FOR FAIL-SAFE DISCONNECT FROM A SUBSEA WELL

BACKGROUND OF THE INVENTION

1. Technical Field of the Invention

The present invention relates to systems and methods for controlled disconnect of a surface vessel from a subsea well, and more particularly, to such a system and method that prevents release of fluids from the conduit into the sea when the conduit is disconnected.

2. Description of Related Art

In operations such as well testing, clean-up, perforating, or other similar operations, a vessel at the sea surface is connected to the wellhead by both a riser and a tubular working string. The position of the vessel is controlled so that the vessel resides over the wellhead to maintain the connection. If the vessel must move away or drive-off from the subsea well, the connection between the vessel and the subsea well must be severed to prevent damaging the vessel, the working string, and the riser. Additionally, the well must be shut-in to prevent a blowout of well fluids, which unfortunately, would be channeled up the riser towards the vessel.

A drive-off may result from several situations. For example, with a dynamically positioned vessel, one or more components of the dynamic positioning system can malfunction and cause the relative position of the vessel and well to suddenly change. A vessel that is held in place by tensioned cables may be propelled away from the well if one of the tensioned cables breaks. Also, the drive-off may be intentional, for example, to avoid a bad weather system.

In conventional systems, the wellhead provides a profile that receives a tubing hanger. The tubing hanger, in turn, supports the working string. The working string may incorporate a retainer valve above a subsea test tree that is actuable to allow or prevent flow through the working string. A blow-out preventer (BOP) stack is provided on the casing at the wellhead, and is actuable to seal the annulus between the working string and the casing.

In normal operations, fluid is communicated between the vessel and well through the working string. The annulus between the working string and the casing is sealed by a packer. In the event of a drive-off, the working string is separated at the wellhead, and the BOP stack seals the annulus. The working string above the wellhead or subsea test tree can then be pulled from the riser, and the working string below the wellhead or subsea test tree is supported in the well by the tubing hanger.

More recently, however, well systems have incorporated a continuous diameter casing and riser with the BOP stack positioned either near the vessel or intermediate the vessel and the sea floor. With such systems, a conventional working string configuration as described above cannot be used, because there is no profile for the tubing hanger to engage or BOP stack to isolate the annulus at the seabed. Thus, in operations, the entire working string is supported from the vessel. In the event of a drive-off, the working string would be pulled from the well as the vessel departs. If the working string were configured to separate, the lower portion of the string would drop unsupported into the well, because there is no tubing hanger to provide vertical support. Additionally, the BOP stack positioned near the vessel or intermediate the vessel and sea floor is above the usual point of separation at the seabed. Consequently, if the work string is parted, the entire volume of the riser above the seabed is exposed to pressurized well effluent which may be released to the environment if the riser is parted or ruptures, alternatively, released gas may evacuate the riser above the seabed and expose it to high collapse pressures which may cause failure.

Therefore, there is a need for a system and method for use in well operations that does not require the working string be supported by a tubing hanger in the event of a drive-off or other situation requiring separation of the working string. Further, the system should seal the annulus between the casing and the working string when the working string is separated.

SUMMARY OF THE INVENTION

The present invention is drawn to a system and method of disconnecting a conduit (e.g. working string) between a surface vessel and a subsea well that minimizes release of fluids into the seawater and that closes in the well. In an exemplary system, a first valve is provided in the upper portion of the conduit and is actuable to a closed position when the conduit separates to prevent fluid flow therethrough. A second valve is provided in the lower portion of the conduit and is actuable to a closed position when the conduit separates to prevent fluid flow therethrough. A well engaging member is provided in the lower portion of the conduit and is configured to engage the tubular member encasing the well (e.g. the well casing) and support the lower portion when the conduit separates.

The invention further encompasses a method of controllably separating a conduit into an upper portion and a lower portion, wherein at least a length of the conduit is residing in a tubular member, or casing, of a well. Except as otherwise noted, the following steps can be performed in any order or simultaneously. A valve above a point of separation is actuated to cease flow from an upper portion of the conduit. A valve below the point of separation is actuated to cease flow from a lower portion of the conduit. A gripping member in the conduit is actuated to engage an inner surface of the tubular member of the well and axially support the lower portion of the conduit. A sealing member in the conduit is actuated to seal an annulus between the tubular member of the well and the conduit. The conduit is separated at the point of separation, and the gripping member is maintained in engagement with the inner surface of the tubular member, and the sealing member is maintained sealing the annulus between the tubular member of the well and the conduit after separating the conduit.

An advantage of the system and method is that fluid in the conduit, or working string, above the point of separation is not released into the sea water.

Another advantage of the system and method is that a blow-out preventer stack can be maintained at the vessel while still retaining the ability to close-in the well near the wellhead.

Another advantage of the invention is that the conduit, or working string, can engage and seal with the casing at several positions along the interior of the tubular member in the well (or casing). This is advantageous in that the invention can test an interval of the well, and be reset to test another interval of the well, all in a single run-in.

Another advantage of the invention is that the hang off tool provides a secondary annulus seal between the working string and the casing, in addition to the seal made by the test packer in the downhole assembly.

Anther advantage of the invention is that actuation of the device can be entirely mechanical, hydraulic and contained within the tools themselves, therefore an umbilical line is not required.

These and other advantages will be apparent from the following drawings and detailed description.

BRIEF DESCRIPTION OF THE DRAWINGS

A more complete understanding of the method and apparatus of the invention may be obtained by reference to the following detailed description when taken in conjunction with the accompanying drawings wherein:

FIG. 7 is a partial side cross-sectional view of an exemplary bypass delay tool for use in the subsea safety system of FIGS. 4A and 4B;

FIG. 9 is a partial side cross-sectional view of an exemplary shut-in valve for use in the subsea safety system of FIGS. 4A and 4B.

DETAILED DESCRIPTION OF THE EXEMPLARY EMBODIMENTS OF THE INVENTION

Figure 1A:
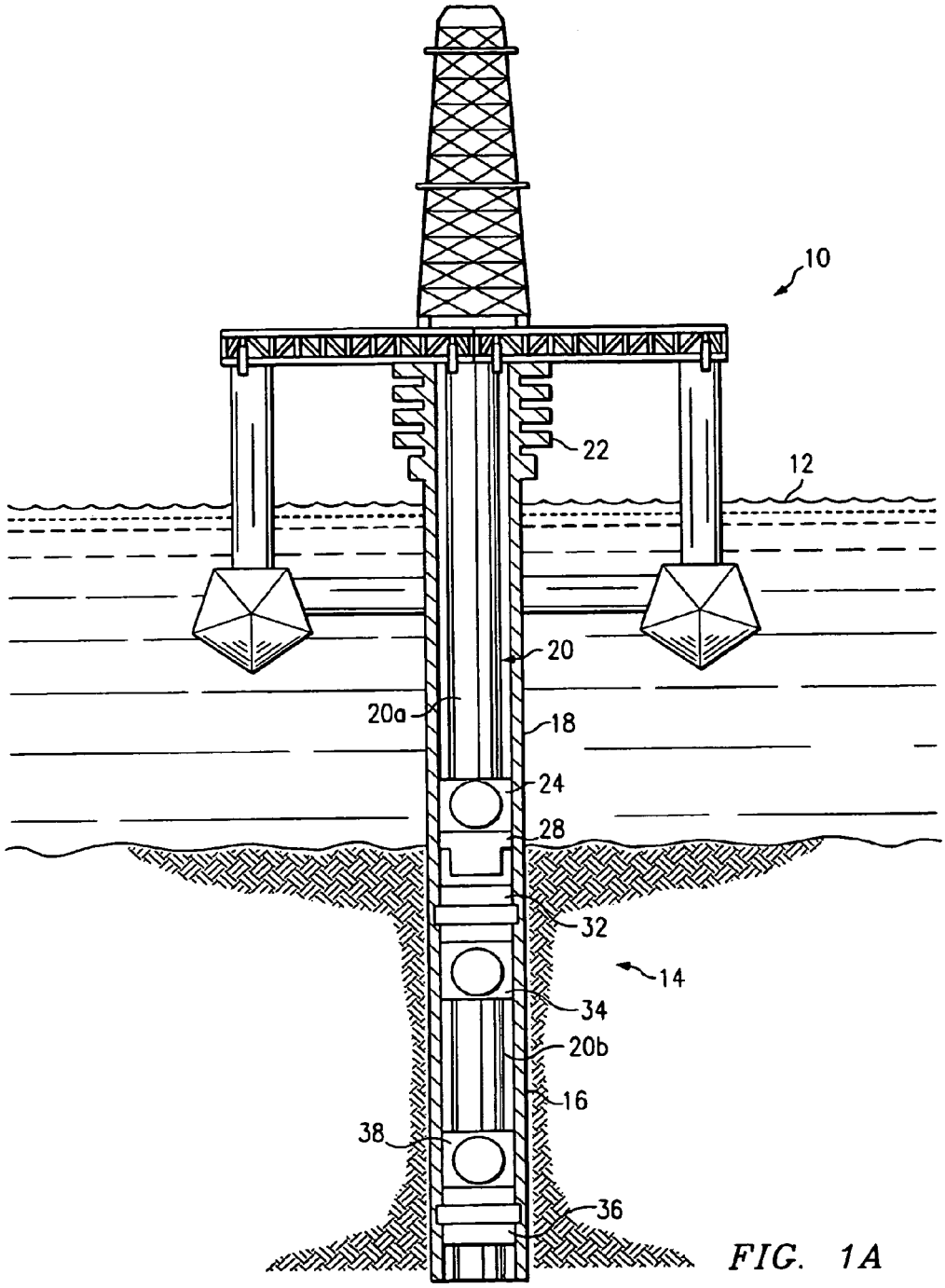
FIG. 1A is a schematic elevational view of an exemplary subsea safety system constructed in accordance with the invention used in a well testing system having a blowout preventer stack near the vessel.

Referring first to FIG 1A, a vessel 10 is shown at the sea surface 12. The vessel 10 is positioned over a subsea wellhead 14. Although, depicted in FIG. 1A as a semi-submersible vessel, the vessel 10 can be of any type, for example but in no means by limitation, a vessel that is moored to the sea floor or a floating, dynamically positioned vessel. Wellhead 14 supports a tubular casing 16 that depends downward into the well. A riser 18 joins to the casing 16 at the wellhead 14, and extends upward to the vessel 10. A working string 20 comprised of several different components depends downward from the vessel 10, through riser 18 and casing 16 and into the well 14. The working string 20 communicates fluid between the vessel 10 and the well 14, and riser 18 acts as a protective housing around the working string 20.

One or more blowout preventers form a blowout preventer (BOP) stack 22 in the riser 18. The BOP stack 22 can be positioned near the vessel 10 (FIG. 1A), near the wellhead 14 (FIG. 2), or at a point intermediate of the wellhead 14 and vessel 10 (FIG. 3). Typically, in a configuration as seen in FIG. 1A, the casing and riser are of the same diameter. The configurations shown in FIGS. 2 and 3, generally have a change in diameter at the BOP stack 22 suitable for engagement by a tubing hanger. The present system can be used with any of the configurations show in FIGS. 1–3.

Referring to FIG. 1A, a safety system constructed in accordance with the invention enables controlled separation of the vessel 10 from the wellhead 14. The safety system of the invention is comprised of several components for carrying out functions of the system, and are hereinafter described as individual components. While the components are described apart from one another, it is to be understood, that one or more of the components can be combined or integrated to form a single device that performs more than one of the functions of the system.

An unlatch tool 28 is included in the working string 20. The unlatch tool 28 enables the working string 20 to be controllably separated into an upper portion 20*a* and a lower portion 20*b*. The unlatch tool 28 can be configured to separate if subjected to a predetermined tensional load, referred to for convenience herein as a break tension. Thus, if the vessel 10 moves away from the wellhead 14, tension through the working string 20 and unlatch tool 28 will exceed the break tension and cause the unlatch tool 28 to separate. The break tension should be chosen high enough to prevent unintentional separation of the unlatch tool 28, yet should also be low enough so as not to dislodge or damage the working string 20. If the working string 20 is sealed to the casing 16, for example by a packer or with a hang-off tool 32 as is discussed in more detail below, the break tension can be chosen to also be low enough that the seal between the working string 20 and casing 16 is not substantially disturbed.

Figure 1B:
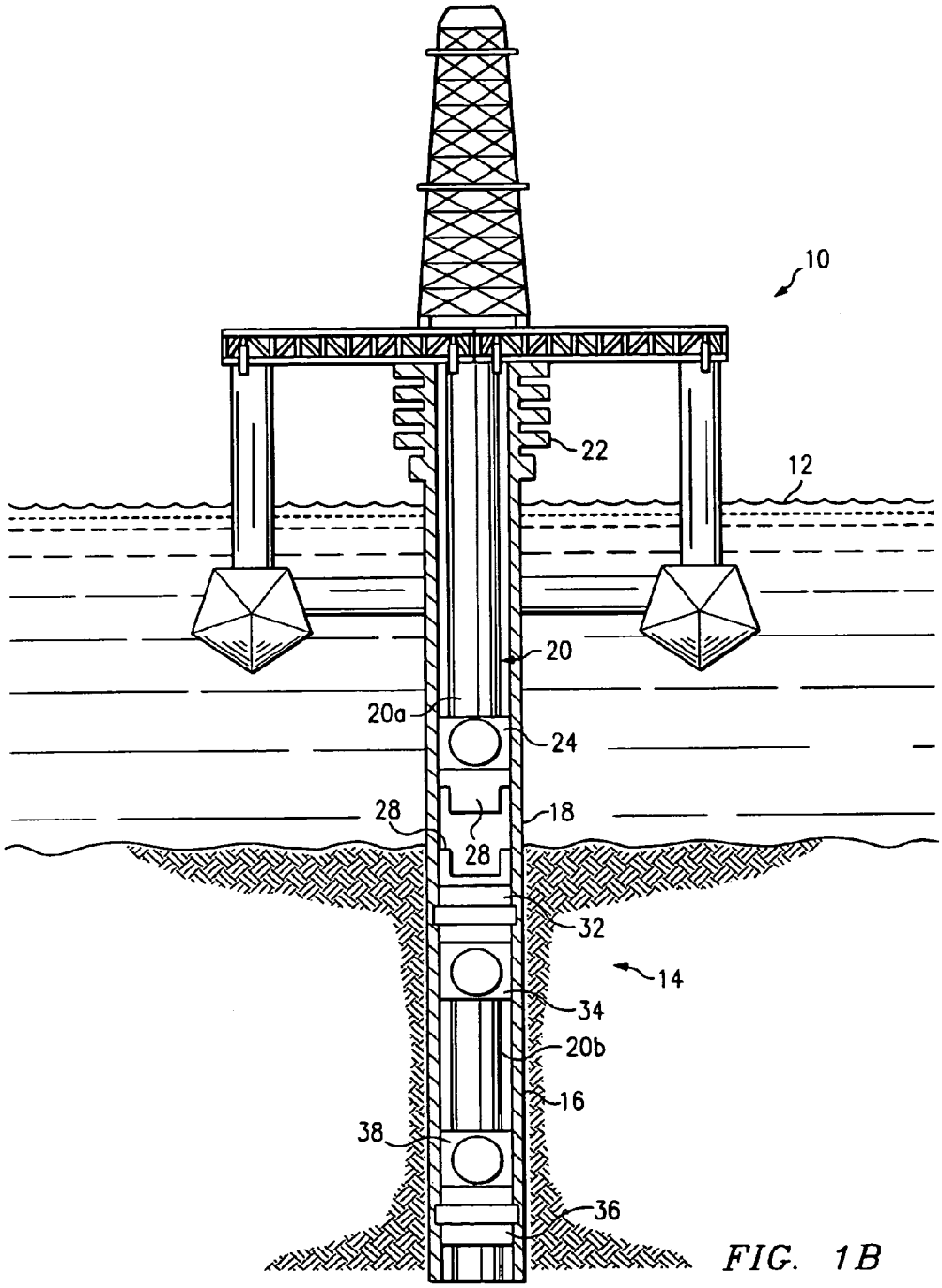
FIG. 1B is a schematic elevational view of the exemplary subsea safety system of FIG. 1A depicting the upper portion of the working string separated from the lower portion of the working string and the hang-off tool engaging the casing.

The unlatch tool 28 can be configured to separate in a non-destructive manner as is depicted in FIG. 1B. In addition, the unlatch tool 28 can be configured to be reconnected without substantial outside intervention. With such an unlatch tool 28, the upper portion of the working string 20*a* can be reconnected to the lower portion of the working string 20*b*, and the unlatch tool 28 reset retain the working string 20 as a single unit until the break tension is exceeded again. The ability to reconnect the unlatch tool 28 is helpful, because otherwise the lower portion of the working string 20*b* must be retrieved from the wellhead 14 after separation and a new working string 20 remade.

In some configurations, the unlatch tool 28 can be changeable between a set condition, where the break tension will separate the tool 28, and an unset condition, where the break tension will not separate the tool 28. Such an unset condition aids in installation and retrieval of the tool, because the operator need not worry that the working string 20 will unintentionally separate. Once in place, the operator may change the unlatch tool 28 to a set condition and the tool 28 will separate at the break tension.

The unlatch tool 28 may be actuable to separate in response to a signal, thereby allowing the operator to cause separation of the working string 20 on command. Other devices in the working string 20 can be actuated using the same or different signaling system as the unlatch tool 28. Such a signal can be hydraulic, for example, hydraulic pressure communicated through a signal line, mechanical, for example, rotation, reciprocation, or other movement of the working string, electrical through the wireline, and/or acoustic, for example by downhole telemetry.

A retainer valve 24 can be included in the working string 20 and positioned above the unlatch tool 28. The retainer valve 24 is a valve that is actuable between an open position to allow flow through the working string 20 and a closed position to substantially stop flow through the working string 20. During normal operation of the working string 20, the retainer valve 24 is maintained in an open position; however, when the working string 20 is separated below the retainer valve 24, such as at the unlatch tool 28, the retainer valve 24 is actuated to a closed position. In the closed position, fluid in the working string 20 above the retainer valve 24 is retained in the working string 20 and cannot flow out into the sea water. Despite the obvious environmental motivations for including a retainer valve 24 in the working string 20, such valve 24 serves an additional purpose, for example, if the fluid in the working string 20 contains a high portion of gas or is almost entirely gas. Without a retainer valve 24, the gas is released into the annulus between the riser 18 and the working string 20 when the working string 20 separates, and creates a pocket of low pressure in the fluids that normally flow in the annulus. The low pressure pocket causes the riser 18 to be susceptible to collapse from the hydrostatic pressure of the seawater surrounding it. Therefore, the retainer valve 24 may be omitted, for example, if hydrostatic pressure is not an issue or depending on the specific application of the subsea safety system.

A hang-off tool 32 is positioned below the unlatch tool 28 and is actuable to engage the inner diameter of the casing 16 or riser 18 to thereby support the lower portion of the working string 20*b* that would remain in the wellhead 14 after separation of the unlatch tool 28. Unlike a tubing hanger that engages a profile in the casing 16, and thus can only engage the casing 16 where the profile is provided, the hang-off tool 32 of the present invention can be configured to engage the casing 16 or riser 18 at any point, for example with slips. The hang-off tool's 32 engagement of the casing 16 or riser 18 can be bi-directional, meaning that it engages the casing 16 and supports against both the downward pull from the weight of the lower portion of the working string 20*b* and an upward pull from the upper portion of the working string 20*a* when tension is applied. The bidirectional nature ensures that the lower portion of the working string 20*b* is not pulled from the wellhead 14 in a drive-off situation when the vessel 10 moves away from the wellhead 14. Alternately, or in addition to the engagement abilities described above, the hang-off tool 32 can be configured to engage a profile in the well.

In addition to engaging the casing 16 or riser 18, the hang-off tool 32 can be actuable to seal against the inner diameter of the casing 16 or riser 18 to thereby seal the annulus between the working string 20 and the casing 16. The hang-off tool 32 can be configured to seal against pressure acting either side of the seal (i.e. bi-directional), for example, pressure from within the well and pressure from above the seal. Sealing the annulus prevents release of fluids in the well 14 into the seawater. Unlike a tubing hanger that engages and seals against a profile in the casing 16, the hang-off tool 32 is configured to seal at any point in the casing 16 or riser. In a system where one or more of the components in the working string 20 are hydraulically actuated, the hang-off tool 32 will have provisions to transmit a hydraulic actuation signal therethrough. Thus, during normal operations and in the event of a drive-off, the hang-off tool 32 can be actuated to seal against the casing 16 and hydraulic signals can continue to be transmitted through the hang-off tool 32 to components beneath the hang-off tool 32.

A shut-in valve 34 is included in the working string 20 and positioned below the hang-off tool 32. Optionally, the shut-in valve 34 can be positioned above the hang-off tool 32 and below the unlatch tool 28 (FIG. 4B). The shut-in valve 34 is actuable between an open position to allow flow through the working string 20 and a closed position to substantially stop flow through the working string 20. During normal operation, the shut-in valve 34 is maintained in an open position to allow flow through the working string 20; however, when the working string 20 is separated above the shut-in valve 34, the shut-in valve 34 is actuated to a closed position and operates to prevent the release fluid in the working string 20 into the seawater.

Figure 2:
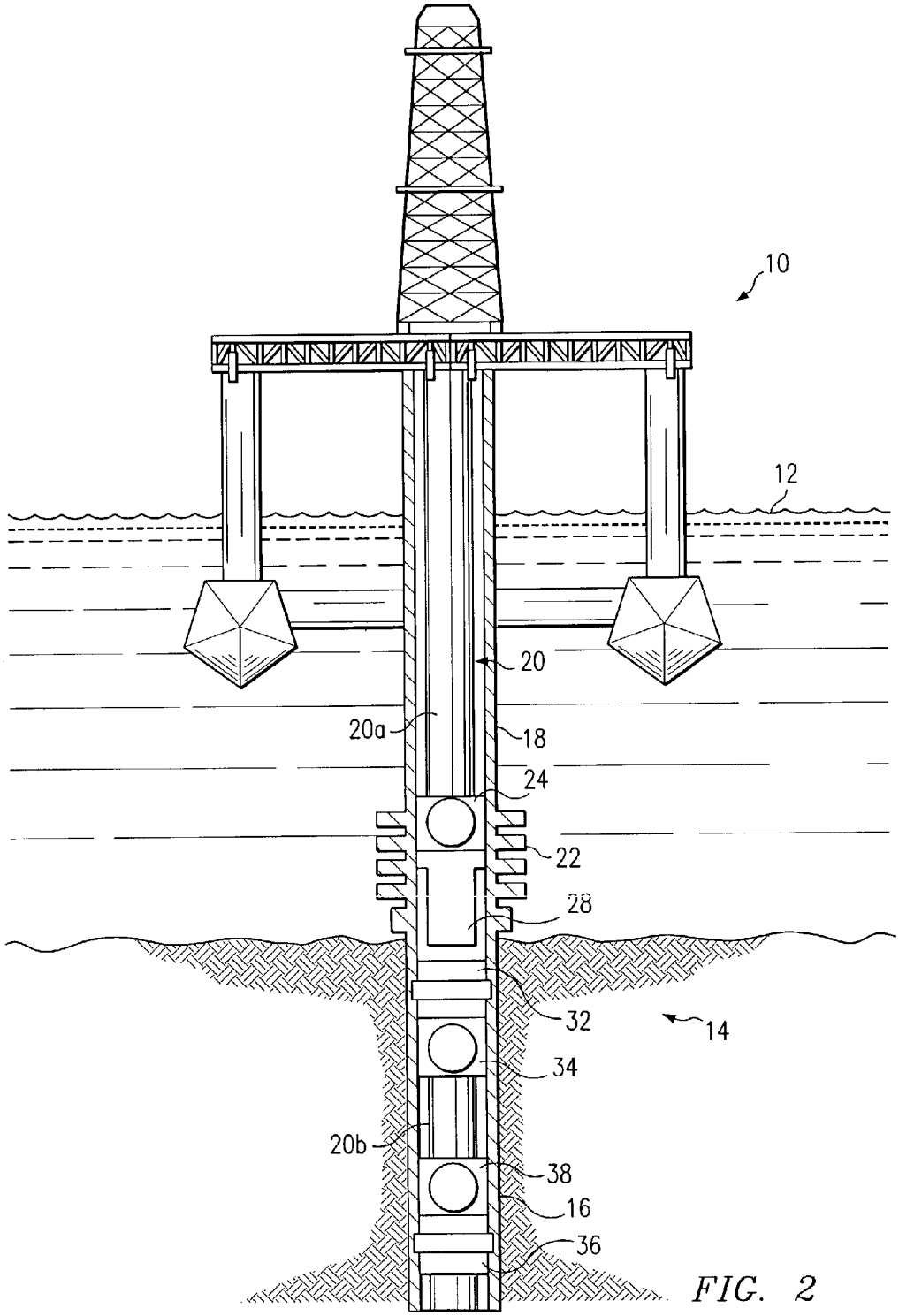
FIG. 2 is a schematic elevational view of an exemplary subsea safety system constructed in accordance with the invention used in a well testing system having a blowout preventer stack near the sea floor.
Figure 3:
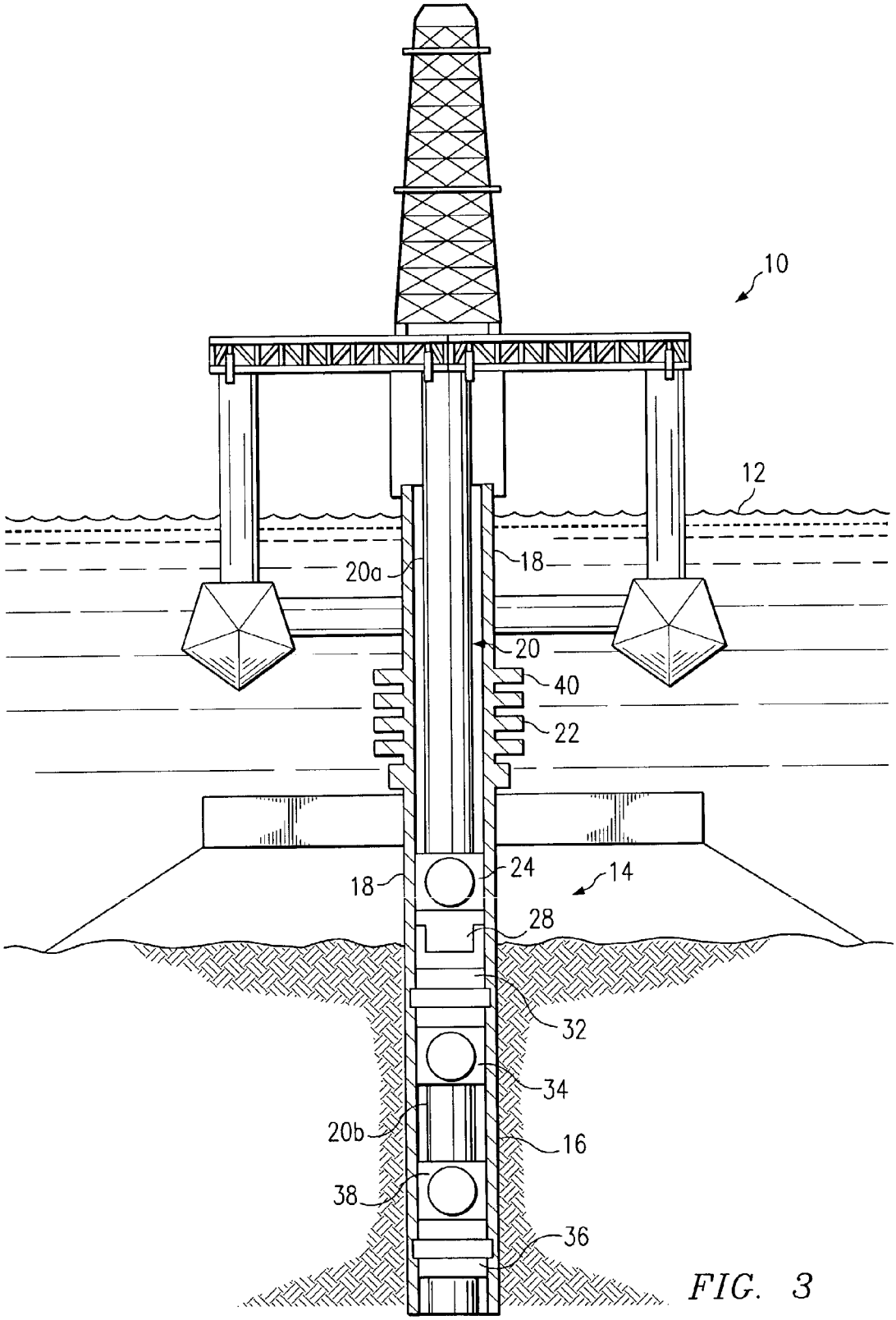
FIG. 3 is a schematic elevational view of an exemplary subsea safety system constructed in accordance with the invention used in a well testing system having a blowout preventer stack intermediate the vessel and the sea floor.

As shown in FIG. 2, the subsea safety system of the present invention can be used in a conventional well operations configuration where the well has a tubing hanger profile at the wellhead 14. The working string 20 need not be supported by a tubing hanger, as was prior practice, but rather can be supported by the hang-off tool 32 as described above. FIG. 2 depicts the BOP stack 22 at the wellhead 14. The hang-off tool 32 is positioned below the BOP stack 22 to engage and seal against the casing 16, while the unlatch tool 28 is positioned to separate the working string 20 above the BOP stack 22. If the point of separation is above the BOP stack 22, the BOP stack can seal the annulus between the working string 20 and the casing 16.

Referring to FIG. 3, the subsea safety system of the present invention can be used in a well operations configuration where the casing 16 is of a smaller diameter than the riser 18, but having the BOP stack 22 intermediate the wellhead 14 and the vessel 10. The working string 20 need not be supported by a tubing hanger, but rather can be supported by the hang-off tool 32 as described above. FIG. 3 additionally depicts a riser release mechanism 40 at the BOP stack 22, that enables the portion of riser 18 above the BOP stack 22 to be separated and remain with the vessel when subjected to a predetermined tension, for example, in the event of a drive-off. Such a release mechanism 40 is well known in the art.

Turning now to the operation of a subsea safety system constructed in accordance with the invention, and referring to FIGS. 1–3, the working string 20, including the components described above, is run into the well through riser 18 and casing 16. If the unlatch tool 28 is changeable between a set and unset condition as described above, the unlatch tool 28 is run into the well in an unset condition to prevent unintentional separation. Thereafter, the unlatch tool 28 is actuated to the set condition to enable the unlatch tool 28 to separate when subjected to the break tension. Once the working string 20 has been run to a desired depth, the hang-off tool 32 can be actuated to engage and seal against the casing 16 and well operations can be conducted.

When the vessel 10 needs to be quickly released from the wellhead 14, for example, in the event of a unintentional drive-off or an intentional disconnect, the shut-in valve 34 is actuated from an open position to a closed position to stop flow of fluids from the lower portion of the working string 20*b*. The retainer valve 24 is also actuated from an open position to a closed position to stop flow of fluids from the upper portion of the working string 20*a*. If not already actuated, the hang-off tool 32 is actuated to engage and seal against the casing 16. The break tension of the unlatch tool 28 is exceeded as the vessel 12 drives off from the wellhead and separates the working string 20 into an upper portion

20*a* and a lower portion 20*b*. The bi-directional engagement of the hang-off tool 32 on the casing 16 prevents upward movement of the working string 20 as the vessel 10 applies tension through the working string 20 to the unlatch tool 28. Alternately, the unlatch tool 28 can be signaled to separate without the tension in the working string 20 exceeding the break tension. The steps of actuating the retainer valve 24 and the shut-in valve 34 can be performed substantially simultaneously, and can be performed before the separation of the unlock tool 28.

After separation, the upper portion of the working string 20*a* is pulled from the riser 18 as the vessel 10 departs from the well. The lower portion of the working string 20*b* remains in the well supported by the hang-off tool 32, and no tubing hanger is required. The hang-off tool 32 seals the annulus between the working string and the casing 16, while the shut-in valve 34 prevents fluid from escaping from the working string 20. Thus, the well 14 is completely shut-in without the use of the BOP stack. Any fluid in the upper portion of the working string 20*a* is retained by the retainer valve 24, and the release of fluids into the sea water is minimized.

If the unlatch tool 28 is configured to be reconnected, the vessel can be repositioned over the well 14 and the upper portion of the working string 20*a* is inserted back into the riser 18 and stabbed into the lower portion of the working string 20*b*. Thereafter, the unlatch tool 28 is reconnected and reset to separate upon reoccurrence of the break tension.

One aspect of the invention beyond the controlled separation sequence described above, is that the hang-off tool 32 can be actuated to engage and seal at various axial positions in the casing 16 and riser 18. Thus, the hang-off tool 32 can be used to test the casing 16 and riser 18 at different depths by engaging and sealing the hang-off tool 32 at various depths within the casing 16 and riser 18 and pressurizing the casing 16 or riser 18 below the seal. In a system that supports the working string 20 on a tubing hanger, this is not possible because the tubing hanger supports the working string 20 only at one depth in the casing 16, i.e. from a profile in the casing. When the hang-off tool 32 is combined with an additional packer 36 (and optionally a tester valve 38), the hang-off tool 32 can be used to test intervals of the casing 16 and riser 18 between the hang-off tool 32 and the packer 36. For example, the hang-off tool 32 can be actuated to engage and seal against the casing 16. Then, the well is pressurized and the packer 36 set to lock the pressure into the interval. Also, multiple hang-off tools 32 can be included in the string, for example to test multiple intervals of the well simultaneously.

It is also important to note that the sealing capability of the hang-off tool 32 can be omitted depending on the specific application. For example, if a packer 36 is provided in the working string, the packer 36 can be actuated to seal the annulus between the working string 20 and the casing 16. Provision of sealing capabilities in the hang-off tool 32 would then be secondary to the seal made by the packer 36, or if a secondary seal is not desired, the hang-off tool 32 seal can be omitted. Also, additional packers 36 can be provided in the working string 20, for example, for additional back-up sealing.

Figure 4A:
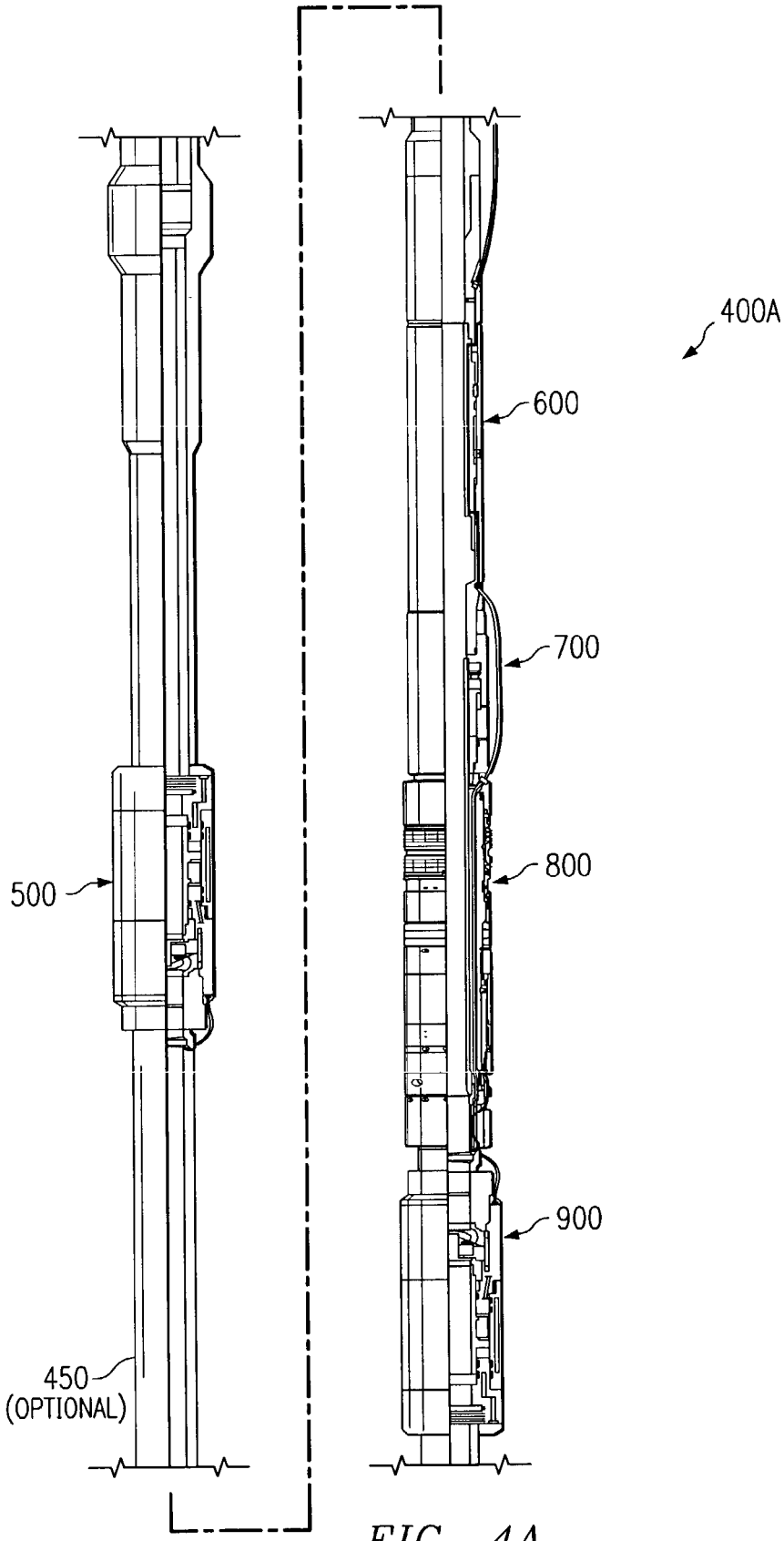
FIG. 4A is a partial side cross-sectional view of a portion of an exemplary working string in accordance with the invention.
Figure 4B:
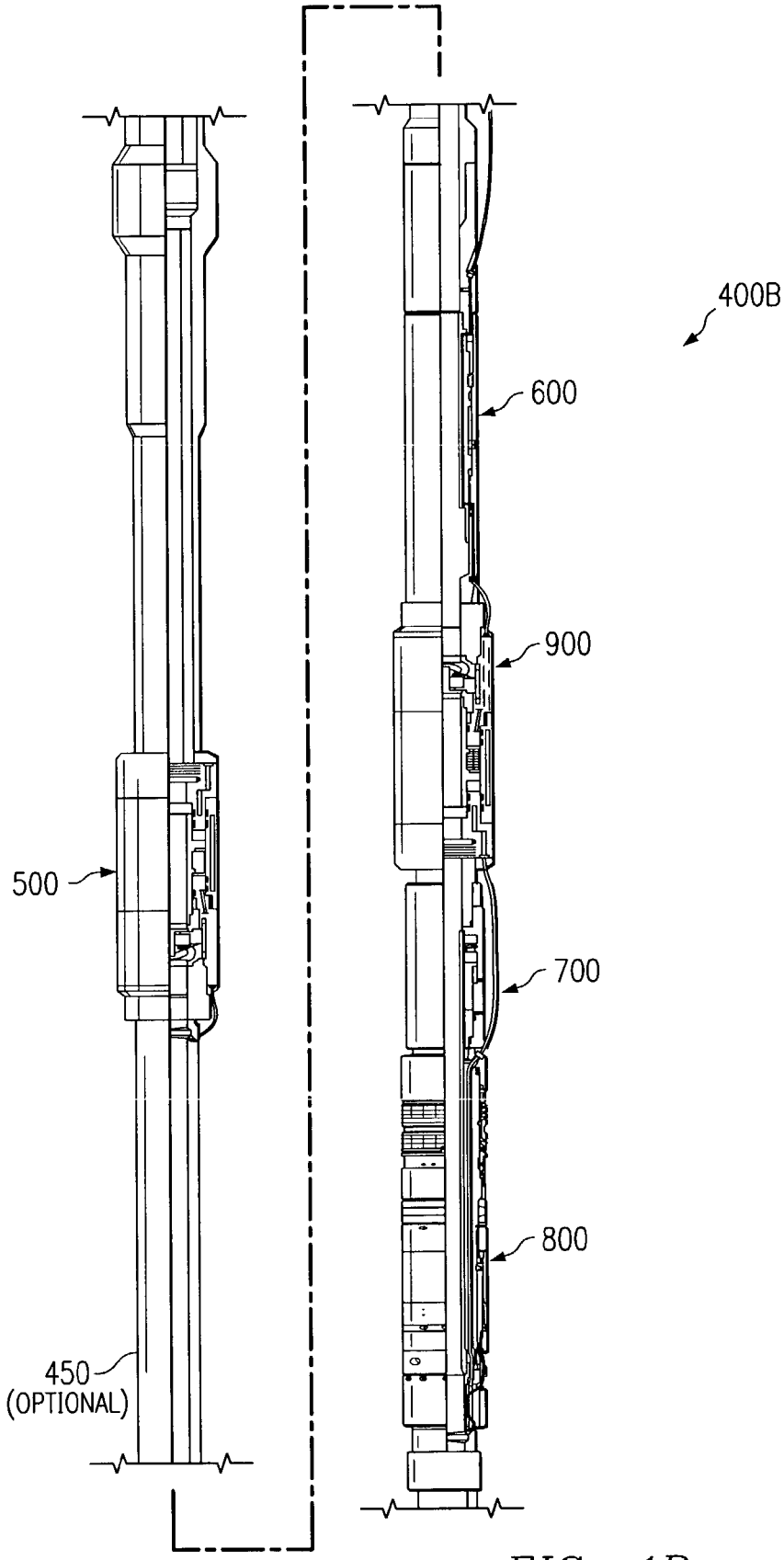
FIG. 4B is a partial side cross-section view of a portion of an alternate exemplary working string in accordance with the invention.

Referring now to FIG. 4A, a portion of an exemplary working string 400A is shown in more detail. The working string 400A includes a retainer valve 500, positioned above the unlatch tool 600, a hydraulic bypass 700, a hang-off tool 800 below the unlatch tool 600, and a shut-in valve 900 below the unlatch tool 600 and the hang-off tool 800. The order of the components in the working string 400A can be modified depending on the configuration of the well. FIG. 4B shows a modified exemplary working string 400B where the hang-off tool 800 is at the lowest point in the string 400B. This increases the distance between the unlatch tool 600 and the hang-off tool 800 for situations such as in FIG. 2, where the unlatch tool 600 and hang-off tool 800 span a BOP stack. Thus, the unlatch tool 600 can be positioned such that the BOP stack can seal against the portion of working string remaining after separation while the hang-off tool 800 engages the casing below the BOP stack.

A shear joint 450 may optionally be included in the working string 400A, 400B together with shear rams (not specifically shown) in the riser or casing. The shear rams are cutting devices actuable to cut though the riser and working string 400A, and the shear joint 450 is a portion of tubing, preferably without any mechanical operation, that is configured to be sheared by the shear rams. The provision of shear rams and a shear joint 450 in the working string 400A, 400B provides an additional mechanism by which the working string 400A, 400B can be separated.

Figure 5:
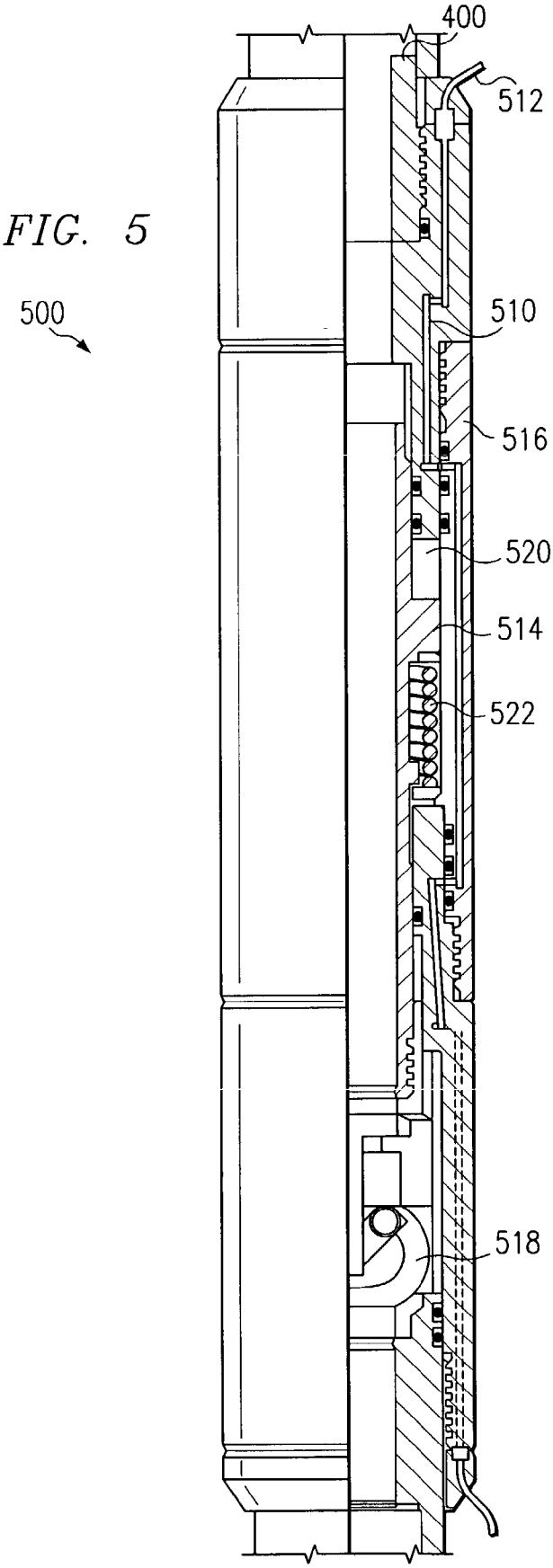
FIG. 5 is a partial side cross-sectional view of an exemplary retainer valve for use in the subsea safety system of FIGS. 4A and 4B.

Referring to FIGS. 5–9, components of the exemplary system of FIGS. 4A and 4B are described in detail. Specifically, with respect to FIG. 5 an exemplary upper retainer valve 500 is shown. The upper retainer valve 500 is configured for inclusion in the working string 400. A hydraulic passage 510, that receives hydraulic pressure through an umbilical 512, allows fluid communication across the retainer valve 500 and supplies hydraulic pressure to actuate the valve 500. A moveable central body 514 is retained in an exterior housing 516 for axial reciprocating movement therein. The central body 514 is coupled to a valve mechanism 518 changeable between an open position allowing fluid flow through the retainer valve 500 and a closed position preventing fluid flow through the retainer valve 500. Axial movement of the central body 514 from an upper position to a lower position changes the valve mechanism 518 from a closed to an open position, respectively. In an exemplary embodiment, the valve mechanism 518 is a spherical ball with a central passage. FIG. 5 shows the valve mechanism 518 in an open position (i.e. the passage in the ball is aligned with the axis of the valve 500 and central body 514 is in the lower position). Thus, upward movement of the body 514 from that shown in FIG. 5 tends to rotate the ball of valve mechanism 518 to the closed position (i.e. where the passage in the ball is not aligned with the axis of the valve 500). The central body 514 is sealed against the exterior housing 516 to create a hydraulic chamber 520 in communication with the hydraulic passage 510. The hydraulic chamber 520 is configured such that hydraulic pressure applied into the chamber 520 forces the central body 514 downward from the upper position to the lower position to actuate the valve mechanism 518 open. A return spring 522 is positioned opposite the hydraulic chamber 520 bearing against the central body 514 and exterior housing 516 to bias the central body 514 to the upper position. The return spring 522 thus biases valve mechanism 518 in an closed position. Therefore, to actuate the retainer valve 500 open, hydraulic pressure is applied through passage 510, and to actuate the retainer valve 500 closed, hydraulic pressure is released. Additionally, hydraulic pressure is communicated across the retainer valve 500 through passage 510 to components of the working string 400 below.

Figure 6:
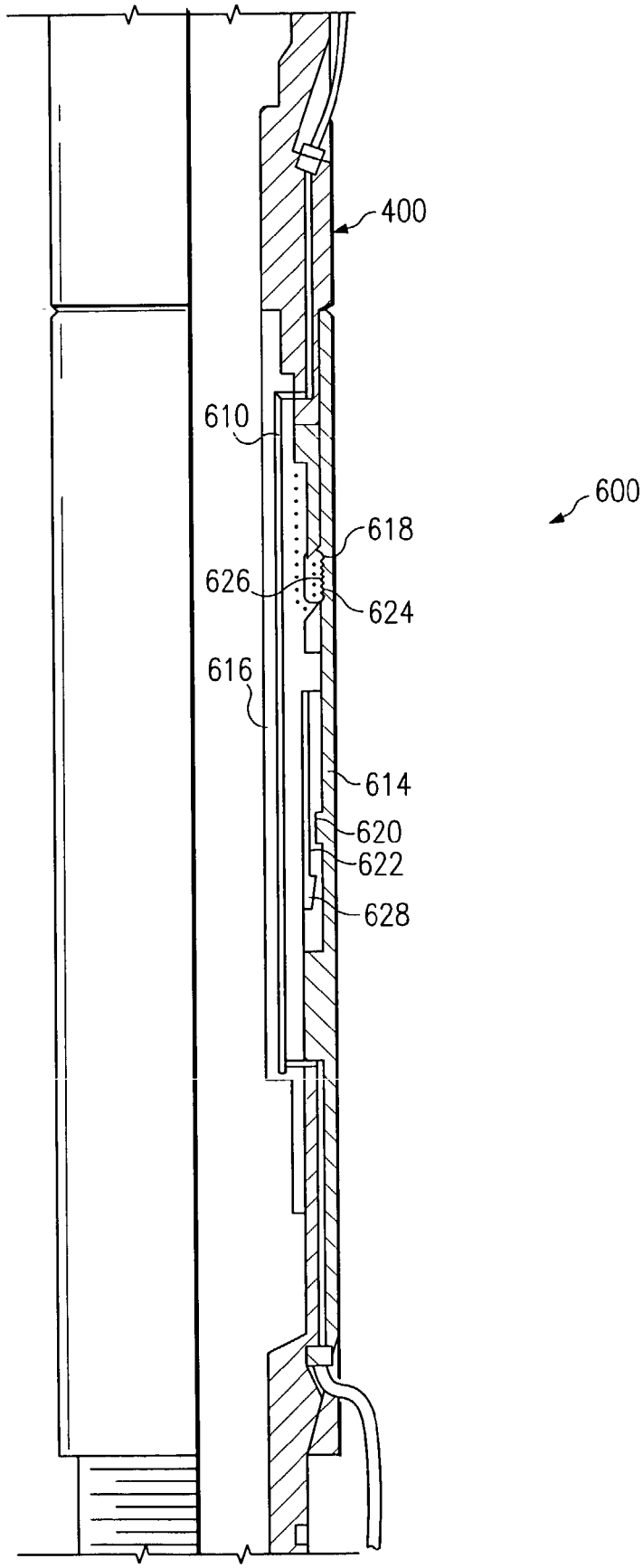
FIG. 6 is a partial side cross-sectional view of an exemplary unlatch tool for in the subsea safety system of FIGS. 4A and 4B.

Referring to FIG. 6, an exemplary unlatch tool 600 is depicted. Unlatch tool 600 is configured for inclusion in the working string 400. A hydraulic passage 610 receives hydraulic pressure from the retainer valve 500 (FIG. 5) and allows fluid communication around the unlatch tool 600.

The unlatch tool 600 is changeable between a set and an unset condition by application of a given torque to the tool 600. In the unset condition seen in FIG. 6, the tool 600 responds as a solid joint of tubing, and in the set condition the tool 600 will predictably separate at a given point when subjected to a predetermined break tension. Accordingly, the unlatch tool 600 has an outer unlatch housing 614 that slidably receives an inner unlatch body 616. The outer unlatch housing 614 is fixed to the working string 400 below the unlatch tool 600 and the inner unlatch body 616 is fixed to the working string 400 above the unlatch tool 600, such that if otherwise unrestrained, torque applied through the working string 400 from the surface would cause the inner unlatch body 616 to rotate in relation to the outer unlatch housing 614. In the unset condition, where the unlatch tool 600 acts as a continuous piece of tubing, a lock ring 618 carried by the inner unlatch body 616 threadably engages, with screw threads 624, corresponding screw threads 626 in the outer unlatch housing 614. The lock ring 618 holds the inner unlatch body 616 and the outer unlatch housing 614 in substantially rigid relation. When torque is applied between the outer unlatch housing 614 and the inner unlatch body 616, the lock ring 618 threadably disengages from the outer unlatch housing 614 allowing relative sliding movement between the outer unlatch housing 614 and the inner unlatch body 616 (i.e. the set condition).

Screw threads 624 can be biased to ratchet over the corresponding threads 626 when the unlatch body 616 is moved inward into the outer unlatch housing 614, and engage the corresponding threads 626 when the unlatch body 616 is moved outward. Such biased threads 624 enables the screw threads 624 to be positioned in engagement with the corresponding threads 626 (and the unlatch tool 600 placed in an unset condition) simply by moving the unlatch body 616 into the outer unlatch housing 614, rather than by threading the unlatch body 616 into the outer unlatch housing 614. However, to disengage the screw threads 624 from corresponding threads 626 (and place the unlatch tool 600 in a set condition), the threads must be unscrewed from one another.

The outer unlatch housing 614 has an inwardly extending stub 620 that is positioned to diametrically interfere with a collet assembly 622 carried by the inner unlatch body 616, and axially positioned to abut the collet assembly 622 when the unlatch tool 600 is in a set condition. Thus, when the locking ring 618 is disengaged from the outer unlatch housing 614, and the inner unlatch body 616 can slide axially relative to the outer unlatch housing 614, the body 616 and housing 614 are retained together by collet assembly 622. The collet assembly 622 is radially inwardly flexible, and is configured to support a load up to the break tension applied through the stub 620 when the unlatch tool 600 is in a set condition. However, when the break tension is reached, the collet assembly 622 is configured to flex inward and allow the stub 620 to pass. In other words, when the break tension is applied to the unlatch tool 600 in a set condition, collet assembly 622 will flex inward and allow stub 620 to pass. Thereafter, the inner unlatch body 616 can then be pulled and separated from the outer unlatch housing 614. Tension less than the break tension applied to the unlatch tool 600 in a set condition will be supported by the collet assembly 622 against the stub 620, thus maintaining the outer unlatch housing 614 and inner unlatch body 616 connected and the unlatch tool 600 together. The leading edge 628 of collet assembly 622 is tapered so that the collet assembly 622 will easily flex inward and pass the stub 620 when the inner unlatch body 616 is inserted into the outer unlatch housing 614.

The hydraulic passage 610 passes through both the outer unlatch housing 614 and the inner unlatch body 616, such that when the unlatch tool 600 separates, the hydraulic pressure in the passage 610 is released to the seawater. With the outer unlatch housing 614 and the inner unlatch body 616 connected, however, the hydraulic passage 610 is continuous.

The unlatch tool 600 can be changed from an unset condition to a set condition, separated, and rejoined to be in an unset condition in the following manner. From an unset condition, torque is applied through the unlatch tool 600 to rotate the inner unlatch body 616 relative to the outer unlatch housing 614. The torque causes lock ring 618 to threadably disengage from the outer unlatch housing 614, and thereby change the unlatch tool 600 to a set condition. In the set condition, a light tension can be applied through the tool 600 to hold collet assembly 622 in abutting relation to stub 620. If the break tension is exceeded, the collet assembly 622 will pass stub 620 and the unlatch tool 600 can separate. To re-join the unlatch tool 600, the inner unlatch body 616 is stabbed into the outer unlatch housing 614. As the inner unlatch body 616 is stabbed into the outer unlatch housing 614, the tapered leading edge of collet assembly 622 wedges collet assembly 622 inward to allow relative easy passage of stub 620, and the screw threads 624 of lock ring 618 will ratchet over corresponding threads 626 of the outer unlatch housing 614. When the inner unlatch body 616 is stabbed substantially fully into the outer unlatch housing 614, screw threads 624 are substantially fully engaged in the corresponding threads 262 and the collet assembly 622 is set over the stub 620. Thus, the unlatch tool 600 is returned to an unset condition.

Referring to FIG. 7, an exemplary bypass delay tool 700 is depicted. The bypass delay tool 700 has a hydraulic passage 710 that receives hydraulic pressure from the hydraulic passage of another work string component, and allows communication of hydraulic pressure around the bypass delay tool 700. The bypass delay tool 700, however, operates to maintain hydraulic pressure below the bypass tool 700 for a given period of time, herein referred to the time delay, when hydraulic pressure above the bypass tool 700 is released (i.e. when the unlatch tool 600 separates). As will be seen from the discussion below, maintaining pressure in the hydraulic passages below the bypass tool 700 is important so that the shut-in valve 900 remains open to maintain pressure in the interior of the working string 400 to maintain components such as additional packer or valve below the bypass tool 700 in operation during the time delay.

The bypass delay tool 700 has an outer bypass housing 712 and inner body 714 that slidably receive a bypass piston 716 therebetween. The bypass piston 716 is sealed internally against the outer bypass housing 712 and the inner body 714 thereby forming a hydraulic chamber 718 between the housing 712, body 714 and the piston 716. The chamber 718 is in communication with the hydraulic fluid passage 710. Bypass piston 716 forms a secondary chamber 720 opposite the first chamber 718. The secondary chamber 720 contains a pressurized gas and a diaphragm 722. The pressure in the secondary chamber 720 is such that if pressure in first chamber 718 is reduced, the pressure in the secondary chamber 720 forces the bypass piston 716 to reduce the volume of the first chamber 718 and force hydraulic fluid out of the first chamber 718 into the hydraulic passage 410. The reduction of volume in the first chamber 718 serves to maintain pressure in the hydraulic passage 710. The diaphragm 722 is provided to help control the rate at which the pressurized gas in the secondary chamber 720 expands, thereby delaying decay of pressure in the secondary chamber 720. The pressure of the compressible gas in the secondary chamber 720 is chosen together with the stroke of the bypass piston 716 and diaphragm 722 to provide hydraulic pressure below the bypass hydraulic chamber 416 for the time delay. After the time delay, hydraulic passage 710 closes off to prevent passage of fluid through the bypass delay tool 700.

Figure 8:
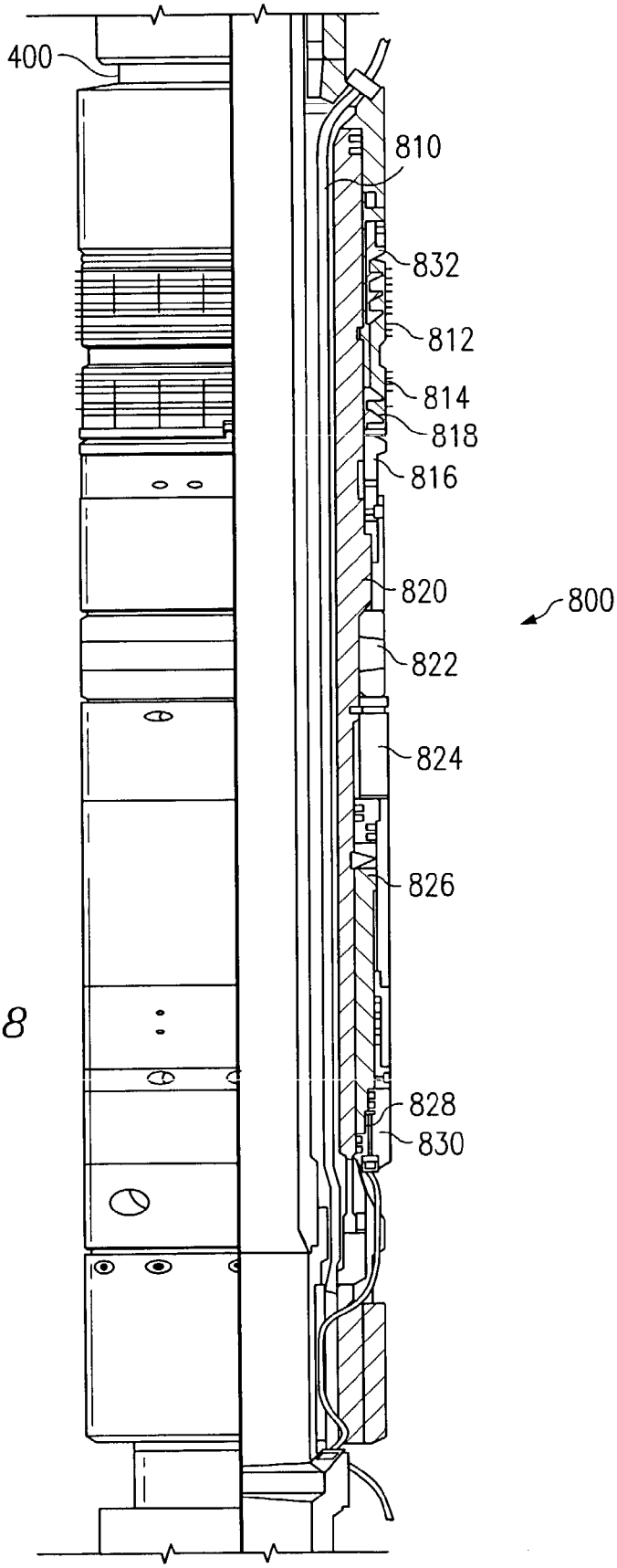
FIG. 8 is a partial side cross-sectional view of an exemplary hang-off tool for in the subsea safety system of FIGS. 4A and 4B.

FIG. 8 depicts an exemplary hang-off tool 800. The hang-off tool 800 has a hydraulic passage 810 that receives hydraulic pressure from the hydraulic passage of another working string component, and allows passage of hydraulic pressure around the hang-off tool 800. The hang-off tool 800 has a first set of slips 812 oriented to engage the casing or riser and prevent downward movement of the hang-off tool 800. The hang-off tool 800 has a second set of slips 814 oriented to engage the casing or riser and prevent upward movement of the hang-off tool 800. A slip actuation sleeve 816 resides beneath the second set of slips 814 and has outwardly protruding sloped ridges 818 that correspond to the inner surface of the slips 814. The slips 812, 814 and slip actuation sleeve 816 are substantially coaxial about an inner body 820. The sloped ridges 818 together with the inner surface of the second set of slips 814 are configured such that when the slip actuation sleeve 816 is moved axially upward in relation to the slips 814, the sloped ridges 818 force the upwardly engaging slips 814 to expand radially outward and into engagement with the casing or riser. Tension in the working string 400 draws the working string 400 (and sleeve 816) upward relative to the slips 814, forcing the slips 814 into harder engagement with the casing or riser. In other words, the slips 814 are configured to be self energizing once in engagement with the casing or riser.

Additional sloped ridges 832 are provided beneath the first set of slips 812 and configured such that downward movement of the ridges 832 relative to the slips 812 forces slips 812 to expand radially outward and into engagement with the casing or riser. Once engaging the casing or riser, the slips 812 will be forced into harder engagement with the casing or riser as the weight of the string 400 pulls downward. The slips 812 are configured to be self energizing once in engagement with the casing or riser. Further, the provision of slips 812 and 814 enables the hang-off tool 800 to engage the casing or riser at virtually any axial position, rather than just at a profile like a tubing hanger, because the slips 812 and 814 can grip the continuous, smooth inner casing or riser surface. In other words, the slips 812, 814 can engage the well at a location independent of the profile of its inner surface.

Elastomeric packer seals 822 are provided on the inner body 820 between the slip actuation sleeve 816 and a packer actuation sleeve 824. The packer actuation sleeve 824 is coupled to a piston 826 that reciprocates axially on the inner body 820 in a chamber 828 formed between an outer housing 830 and the inner body 820. The chamber 828 is in communication with the interior of the working string 400, so that pressure applied through the working string 400 pressurizes the chamber 828. When the chamber 828 is pressurized, the piston 826 moves toward the packer seals 822 forcing the packer actuation sleeve 824 to axially compress the packer seals 822. As the packer seals 822 are compressed axially, they deflect radially outward and into sealing contact with the casing or riser. Additionally, the upward force on the packer seals 822 and packer actuation sleeve 824, provides an upward force on the slip actuation sleeve 816 thereby actuating the slips 812, 814. Thus, to actuate the hang-off tool 800 to seal and engage the casing or riser, pressure in the working string 400 is increased to actuate the slips 812, 814 and packer seals 822 into engagement with the casing or riser. Also, because of the specific configuration of the packer actuation sleeve 824, slip actuation sleeve 824 and inner body 820, such the packer seals 822 form a bidirectional seal.

Piston 826 frictionally engages a portion of outer housing 830, for example with a ridged surface (not specifically shown), that tends to retain piston 826 in an actuated state (i.e. axially compressing packers 822 and with slips 812 and 814 radially extended). Therefore, if pressure is released from the interior of the working string 400, the slips 812 and 814 and packers 822 continue to engage and seal against the casing or riser, because the piston 826 is frictionally held in place. Piston 826 can be reset, and slips 812,814 and packers 822 disengaged from the casing or riser by reducing the pressure within in the working string 400 and applying an over pull tension to the string 400. Such an over pull tension will overcome the frictional engagement of the piston 826 with the outer housing 830, and allow the slips 812, 814 and packers 822 to return to a radially retracted position. The over pull tension need not be higher than the break tension of the unlatch tool 600, because in a drive off condition, pressure is generally maintained in the working string 400 to energize the piston 826 as the unlatch tool 600 separates. Additionally, it may be desirable to change the unlatch tool 600 to the unset condition before applying the over pull tension to guard against unintended separation of the unlatch tool 600.

With respect to FIG. 9 an exemplary shut-in valve 900 is shown. The shut-in valve 900 is configured for inclusion in the working string 400. A hydraulic passage 910, that receives hydraulic pressure from the hydraulic passage of another working string component, allows fluid communication across the shut-in valve 900 and supplies hydraulic pressure to actuate the valve 900. A moveable central body 914 is retained in a exterior housing 916 for axial reciprocating movement therein. The central body 914 is coupled to a valve mechanism 918 changeable between an open position allowing fluid flow through the shut-in valve 900 and a closed position preventing fluid flow through the shut-in valve 900. Axial movement of the central body 914 from an upper position to a lower position changes the valve mechanism 918 from an open to a closed position. In an exemplary embodiment, the valve mechanism 918 is a spherical ball with a central passage. FIG. 9 shows the valve mechanism 918 in an open position (i.e. the passage in the ball is aligned with the axis of the valve 900 and the central body 914 is in the upper position). Thus, downward movement of the body 914 tends to rotate the ball of valve mechanism 918 to the closed position (i.e. where the passage in the ball is not aligned with the axis of the valve 900). The central body 914 is sealed against the exterior housing 916 to create a hydraulic chamber 920 in communication with the hydraulic passage 910. The hydraulic chamber 920 is configured such that hydraulic pressure applied into the chamber 920 forces the central body 914 upward from the lower position to the upper position to actuate the valve mechanism 918 open. A return spring 922 is opposite the hydraulic chamber 920 bearing against the central body 914 and exterior housing 916 to bias the central body 914 to the downward position. The return spring 922 thus biases valve mechanism 918 in an closed position. Therefore, to actuate the shut-in valve 900 open, hydraulic pressure is applied through passage 910, and to actuate the shut-in valve 900 closed, hydraulic pressure is released. Additionally, hydraulic pressure is communicated across the shut-in valve 900 through passage 910 to components of the working string 400 below.

In operation, the working string 400 is inserted into a riser as discussed with respect to FIGS. 1–3 with the unlatch tool 600 in the unset condition (i.e. with lock ring 618 threadably engaging the outer unlatch housing 614). Pressure within the working string is modulated to engage and seal the hang-off tool 800 with the interior of the casing or riser. Because the hang-off tool 800 uses slips 812, 814 to engage the casing or riser, and does not engage a profile in the casing as would a tubing hanger, the hang-off tool 800 can be engaged and seal at virtually any point in the casing or riser. When the hang-off tool 800 is engaged to support the working string 400 at a desired height, the working string 400 is rotated to change the unlatch tool 600 to the set condition (i.e. with lock ring 618 disengaged from the outer unlatch housing 614) and a light tension is applied through the working string 400. Pressure through the hydraulic passages is modulated to maintain the retainer valve 500 and shut-in valve 900 open to allow fluid flow through the working string 400.

When the vessel drives-off from the well, tension is increased through the working string 400 as weight of the working string 400 and the slips 812 of the hang-off tool 800 resist the vessel's upward pull on the working string 400. When the tension exceeds the break tension, unlatch tool 600 separates as collet assembly 622 flexes inward and passes stub 620. The working string 400 above the unlatch tool 600 is pulled from the riser. The working string 400 below the unlatch tool 600 is supported by the slips 814 in hang-off tool 800. At the same time, the hydraulic passage 610 in the unlatch tool 600 is opened to the sea water and pressure is released from the respective hydraulic passages of each of the working string 400 components. Release of pressure in hydraulic passage 510 of the retainer valve 500 allows spring 522 to actuate the valve mechanism 518 to a closed position and minimize the release of fluids in the working string above the retainer valve 500 into the seawater. The bypass delay tool 700, however, maintains pressure in the hydraulic passages below the bypass tool 700 for a given delay time. Pressure in the hydraulic passages, specifically hydraulic passage 910 of the shut-in valve 900, maintains the shut-in valve 900 open during the delay time allowing pressure from the well to continue to actuate the hang-off tool 800 to engage and seal against the casing. As the weight of the working string 400 below the bypass tool 700 comes to be fully supported by the hang-off tool 800, the slips 812 engage the riser and support the remaining portion of the working string. After the delay time, the shut-in valve 900 closes.

It is important to note that while the system and methods described herein have been discussed in the context of a deep water subsea well, the invention is equally applicable to a shallow water underwater well and or a well on land. Operation of the devices and the configuration of the working string would be similar to that described above, although the specific application may allow for differences from the system described above. For example, when the system is used in a shallow water underwater well, a retainer valve (e.g. retainer valve 24 or 500) can be omitted from the system, because there is less hydrostatic pressure from the water on the riser and thus less issue of riser collapse. Likewise, when the system is used with a well on land, the retainer valve can be omitted, because there is no riser. In either case, land or shallow water, however, the retainer valve can be included for other reasons (e.g. environmental concerns).

Although several exemplary embodiments of the methods and systems of the invention have been illustrated in the accompanying drawings and described in the foregoing description, it will be understood that the invention is not limited to the embodiments disclosed, but is capable of numerous rearrangements, modifications and substations without departing from the spirit and scope of the invention as defined in the following claims.

We claim:

1. A system for controlled separation of a conduit into an upper portion and a lower portion, wherein at least a length of the conduit is residing in a tubular member of a well, the system comprising:

a separation joint at which the conduit is separated into the upper portion and the lower portion;

a valve in the lower portion of the conduit operable to prevent fluid flow through the lower portion of the conduit;

a well engaging member in the lower portion of the conduit actuable to engage an interior surface of the tubular member and axially support the lower portion of the conduit at a location independent of a profile of the interior surface;

one or more devices in the lower portion of the conduit;

a passage operable to communicate a hydraulic signal from above the well engaging member to one or more of the devices.

2. The system of claim 1 further comprising a seal member in the lower portion actuable to seal an annulus between the conduit and the tubular member.

3. A system for controlled separation of a conduit into an upper portion and a lower portion, wherein at least a length of the conduit is residing in a tubular member of the well, the system comprising:

a separation joint at which the conduit is seperated into the upper portion and the lower portion;

a valve in the lower portion of the conduit operable to prevent fluid flow through the lower portion of the conduit; and a well engaging member in the lower portion of the conduit actuable to engage an interior surface of the tubular member and axially support the lower portion of the conduit at a location independdent of a profile of the interior surface; and further comprising a hydraulic passage about the conduit that allows communication of hydraulic pressure in the passage from a first location on a side of the seal to a second location on an opposing side of the seal when the seal is actuated to seal the annulus between the conduit and the tubular member.

4. The system of claim 1 wherein the well engaging member engages an interior surface of the tubular member with slips.

5. The system of claim 1 wherein the tubular member is a riser.

6. The system of claim 1 wherein the tubular member is a casing.

7. A system for controlled separation of a conduit into an upper portion and a lower portion, wherein at least a length of the conduit is residing in a tubular member of the well, the system comprising:

a separation joint at which the conduit is seperated into the upper portion and the lower portion;

a valve in the lower portion of the conduit operable to prevent fluid flow through the lower portion of the conduit; and a well engaging member in the lower portion of the conduit actuable to engage an interior surface of the tubular member and axially support the lower portion of the conduit at a location independdent of a profile of the interior surface; and wherein the well engagement member supports the lower portion of the conduit against movement in a first and a second axial directions.

8. The system of claim 1 wherein engagement of the well engagement member with the interior surface of the tubular member is increased by a downward load on the conduit.

9. The system of claim 1 wherein engagement of the well engagement member with the interior surface of the tubular member is increased by an upward load on the conduit.

10. The system of claim 1 wherein the separation joint in the conduit is adapted to separate when subjected to a predetermined tension.

11. A system for controlled separation of a conduit into an upper portion and a lower portion, wherein at least a length of the conduit is residing in a tubular member of a well, the system comprising;

a separation joint at which the conduit is seperated into the upper portion and the lower portion;

a valve in the lower portion of the conduit operable to prevent fluid flow through the lower portion of the conduit; and a well engaging member in the lower portion of the conduit actuable to engage an interior surface of the tubular member and axially support the lower portion of the conduit at a location independdent of a profile of the interior surface; and wherein the separation joint in the conduit is changeable between a set condition wherein the separation joint will separate when subjected to a predetermined tension and an unset condition wherein the separation joint remains together when subjected to the predetermined tension.

12. A system for controlled separation of a conduit into an upper portion and a lower portion, wherein at least a length of the conduit is residing in a tubular member of a well, the system comprising:

a separation joint at which the conduit is seperated into the upper portion and the lower portion;

a valve in the lower portion of the conduit operable to prevent fluid flow through the lower portion of the conduit; and a well engaging member in the lower portion of the conduit actuable to engage an interior surface of the tubular member and axially support the lower portion of the conduit at a location independdent of a profile of the interior surface; and wherein the separation joint is actuated by a signal to seperate.

13. The system of claim 12 wherein the signal comprises at least one of a hydraulic signal, an electrical signal, an acoustic signal, and a mechanical signal.

14. The system of claim 1 wherein a predetermined hydraulic pressure in the interior of the conduit actuates the well engaging member to engage the interior surface of the tubular member.

15. The system of claim 1 wherein the valve is below the well engaging member.

16. The system of claim 1 wherein the valve is above the well engaging member.

17. A system for controlled separation of a conduit into an upper portion and a lower portion, wherein at least a length of the conduit is residing in a tubular member of a well, the system comprising:

a separation joint at which the conduit is seperated into the upper portion and the lower portion;

a valve in the lower portion of the conduit operable to prevent fluid flow through the lower portion of the conduit; and a well engaging member in the lower portion of the conduit actuable to engage an interior surface of the tubular member and axially support the lower portion of the conduit at a location independdent of a profile of the interior surface; and wherein the valve is adapted to close upon cessation of a received signal, and wherein the signal is ceased when the conduit separates.

18. The system of claim 17 wherein the valve is biased closed and maintained in an open position by hydraulic pressure, and wherein the hydraulic pressure is released when the conduit separates.

19. The system of claim 17 further comprising a signal delay assembly adapted to maintain the signal to the valve for a length of time after the conduit separates.

20. The system of claim 19 wherein the signal is hydraulic pressure.

21. The system of claim 17 further comprising:

a seal member in the lower portion operable to seal an annulus between the conduit and the tubular member;

a hydraulic passage about the conduit that allows communication of hydraulic pressure in the passage from a first location on a side of the seal to a second location on an opposing side of the seal; and wherein the signal is hydraulic pressure supplied through the hydraulic passage.

22. The system of claim 21 wherein the valve is below the seal member.

23. The system of claim 2 further comprising a second seal member in the lower portion of the conduit and spaced from the first mentioned seal member, the second seal member operable to seal an annulus between the conduit and the tubular member.

24. The system of claim 1 further comprising a second valve in the lower portion of the conduit operable to prevent fluid flow through the lower portion of the conduit.

25. The system of claim 1 further comprising a second valve in the upper portion of the conduit operable to prevent fluid flow through the upper portion of the conduit.

26. A method of controllably separating a conduit into an upper portion and a lower portion, wherein at least a length of the conduit is residing in a tubular member of a well, the method comprising:

actuating a valve below a point of separation to cease flow from a lower portion of the conduit;

actuating a gripping member in the conduit to engage an inner surface of the tubular member of the well and axially support the lower portion of the conduit; and separating the conduit at the point of separation when the conduit is subjected to a predetermined tension.

27. The method of claim 26 wherein separating the conduit at the point of separation comprises applying a break tension to the conduit while the conduit below the point of separation is axially supported against the tension.

28. The method of claim 26 wherein separating the conduit at the point of separation comprises non-destructively separating the conduit.

29. The method of claim 26 further comprising, after separating the conduit at the point of separation, rejoining the conduit at the point of separation.

30. The method of claim 26 further comprising actuating a valve above the point of separation to cease flow from an upper portion of the conduit.

31. The method of claim 26 further comprising actuating a sealing member in the conduit to seal an annulus between the tubular member of the well and the conduit.

32. The method of claim 31 wherein actuating a sealing member in the conduit further comprises actuating the sealing member to seal against pressure acting on at least one of a first side of the seal and a second side of the seal.

33. The method of claim 31 further comprising transmitting a signal from a first location on a first side of the seal to a second location on an opposing side of the seal when the seal is actuated to seal the annulus between the tubular member of the well and the conduit.

34. The method of claim 33 wherein the signal comprises at least one of a hydraulic signal, an electrical signal, an acoustic signal, and a mechanical signal.

35. The method of claim 33 wherein the signal originates from a location above the point of separation and is transmitted on a transmission line that is severed when the conduit is separated, the method further comprising maintaining the signal at the second location after the conduit separates at the point of separation.

36. The method of claim 26 further comprising maintaining the gripping member in engagement with the inner surface of the tubular member and the sealing member sealing the annulus between the tubular member of the well and the conduit after separating the conduit.

37. The method of claim 26 further comprising, before separating the conduit at the point of separation and after actuating the gripping member to engage the inner surface of the tubular member, actuating the gripping member to disengage from the inner surface of the tubular member of the well; and actuating the gripping member again to engage the inner surface of the tubular member.

38. The method of claim 37 wherein actuating the gripping member again comprises, actuating the gripping member again to engage the inner surface of the tubular member at a different location than where the gripping member previously engaged the inner surface of the tubular member.

39. The method of claim 26 wherein actuating the gripping member in the conduit comprises actuating the gripping member to axially support against loads acting in at least one of a first axial direction and a second axial direction.

40. The system of claim 1 wherein at least one of the one or more devices in the lower portion of the conduit is a valve.

* * * * *